US008656834B2

(12) United States Patent
Naka

(10) Patent No.: US 8,656,834 B2
(45) Date of Patent: Feb. 25, 2014

(54) EXCHANGEABLE CYLINDER TYPE ROTARY PRESS

(75) Inventor: Masahiro Naka, Narashino (JP)

(73) Assignee: Miyakoshi Printing Machinery Co., Ltd., Chiba (JP)

( * ) Notice: Subject to any disclaimer, the term of this patent is extended or adjusted under 35 U.S.C. 154(b) by 948 days.

(21) Appl. No.: 11/825,968

(22) Filed: Jul. 10, 2007

(65) Prior Publication Data

US 2008/0017058 A1 Jan. 24, 2008

(30) Foreign Application Priority Data

Jul. 18, 2006 (JP) ..... 2006-195683

(51) Int. Cl.
*B41F 13/44* (2006.01)

(52) U.S. Cl.
USPC ..... 101/216; 101/141; 101/174; 101/177; 101/217

(58) Field of Classification Search
USPC ..... 101/216
See application file for complete search history.

(56) References Cited

U.S. PATENT DOCUMENTS

| | | | | |
|---|---|---|---|---|
| 3,713,420 | A * | 1/1973 | Pfaffle | 118/212 |
| 3,742,849 | A * | 7/1973 | Greiner et al. | 101/220 |
| 4,394,835 | A * | 7/1983 | Gertsch et al. | 101/177 |
| 4,398,464 | A * | 8/1983 | Morbitzer et al. | 101/177 |
| 5,152,224 | A * | 10/1992 | Guaraldi | 101/350.3 |
| 5,165,341 | A * | 11/1992 | John et al. | 101/217 |
| 5,355,742 | A * | 10/1994 | Herrmann | 74/409 |
| 5,377,589 | A * | 1/1995 | Kruger et al. | 101/248 |
| 5,983,793 | A * | 11/1999 | Volz et al. | 101/216 |
| 6,829,991 | B1 * | 12/2004 | Eaton | 101/217 |
| 6,848,359 | B2 * | 2/2005 | Ruoff | 101/5 |
| 2002/0121202 | A1 * | 9/2002 | Naka | 101/218 |
| 2003/0230206 | A1 * | 12/2003 | Ruoff | 101/216 |
| 2003/0230618 | A1 * | 12/2003 | Ruoff | 226/108 |
| 2005/0016397 | A1 * | 1/2005 | Masuch | 101/216 |

FOREIGN PATENT DOCUMENTS

| | | |
|---|---|---|
| JP | 58-138649 | 8/1983 |
| JP | 2003-053930 | 2/2003 |

OTHER PUBLICATIONS

Kohara Gear Industry "Introduction to Gears", KHK Stock Gears, Oct. 2006.

* cited by examiner

*Primary Examiner* — Jill Culler
(74) *Attorney, Agent, or Firm* — Cozen O'Connor

(57) ABSTRACT

In an exchangeable cylinder type rotary press driven by a prime mover, it is made possible to make a print of any top-bottom length as desired, independently of a gear train that transmits power from the prime mover to an exchange cylinder unit. To this end, the peripheral length of each of the rotary cylinders 34-36 in the exchange cylinder unit 28 is set at a length according to a top-bottom length of a print to be made, a profile-shifted gear is used as at least one of driven gears 37-39 which are provided for the rotary cylinders, respectively, and have an identical number of teeth so that the driven gears can be engaged with one another while positioning the rotary cylinders in rotational contact with one another, the printing unit 25 is provided in the exchange cylinder unit with a driving gear 30 adapted to be disengageably in engagement with one of the driven gears for driving the exchangeable cylinders, the driving gear being provided independently of the rotary printing paper feed means; and a motor 32 whose rotation is controllable is coupled to the driving gear.

7 Claims, 11 Drawing Sheets

EXCHANGEABLE CYLINDER TYPE ROTARY PRESS

BACKGROUND OF THE INVENTION

1. Technical Field

The present invention relates to an exchangeable cylinder type rotary press, which is driven via a driving shaft by a single prime mover and which is capable of conventional printing in an inch standard (with inch used as size unit) but which is also adapted for printing in a millimeter standard (with millimeter used as size unit), or printing in any top-bottom length as desired, independent of a power transmission system from the prime mover.

2. Description of the Prior Art

FIG. 1 is a view illustrating an example of the exchangeable cylinder type rotary press (hereinafter referred to simply as "rotary press") as seen from the side of the prime mover. The rotary press is equipped in turn from the upstream side of travel of rotary printing paper 1 with a paper feeder 2, a printing section 3 and a machining section 4. Supplied from the paper feeder 2, rotary printing paper 1 is printed as desired in the printing section 3 and then machined as desired in the machining section 4 in which for example, longitudinal-perforating, file punching, lateral-perforating and sheet cutting are performed at a longitudinal-perforating unit 4*a*, a file punching unit 4*b*, a lateral-perforating unit 4*c* and a sheet cutting unit 4*d*, respectively, the rotary printing paper being thereafter discharged. The printing section 3 here comprises a plurality of, e. g., four, printing units, 3*a*, 3*b*, 3*c* and 3*d*, each of which has a three-cylinder exchangeable, exchange cylinder unit 12 removably mounted thereon comprising a printing cylinder 9, a blanket cylinder 10 and an impression cylinder 11. Further, a paper feed roller 13*a* and a machining section tension roller 13*b* are provided, constituting a rotary printing paper feed means.

And, driven parts in this rotary press are coupled to their respective power transmission drives 14, 14, . . . on the side of the machine frame, all of which are coupled via a driving shaft 15 to a single prime mover 16 so that all these driven parts may be synchronously driven by the single prime mover 16 via the driving shaft 15 and the respective power transmission drives 14.

Further, in the rotary press of this type, rotary printing paper 1 may also bypass the machining section 4 and be directly wound and processed on a take-up section 2*a*.

The printing units 3*a* to 3*d* are of an identical construction, one of which, e. g., printing unit 3*a*, has a power transmission system as shown in FIG. 2. In the printing unit 3*a*, rotation of the power transmission drive 14 is transferred via a gear train 17 to a driving gear 18 mounted on the principal machine side. And, with the three-cylinder exchangeable, exchange cylinder unit 12 mounted on the printing unit 12*a*, a driven gear 19 of the printing cylinder 9 mounted coaxially with the printing cylinder 9 is engaged with its driving gear 18 for driving the exchange cylinder unit 12. Further, The blanket cylinder 10 and the impression cylinder 11 have their respective driven gears 20 and 21 which are mounted coaxially with them, respectively, so as to serially engage the driven gear 19 of the printing cylinder 9.

The driven gear 19, 20, 21 has a pitch circumferential length (or pitch circle diameter) which is identical to a peripheral length (or diameter) of the cylinders 9, 10 and 11. And, when driven by the driving gear 18, the driven gears 19, 20 and 21 are rotated in their respective pitch circumferences at a speed which is identical to a rate of travel of rotary printing paper 1 determined by rotation of the prime mover 16. And, continuous paper 1 passing between the blanket and impression cylinders 10 and 11 rotated together with them is drive to travel at the abovementioned speed of travel.

And, a rotary press of this type has been made in inch as size unit and thus the driving gear 18 has been made in inch as size unit and accordingly the driven gears 19, 20 and 21 of the cylinders of the exchange cylinder units 12 have been made in inch as size unit.

In such a rotary press, if its driving gear 18 used is a gear whose CP (circular pitch) is ¼ to print in a top-bottom length of 22 inches, as an example the driven gear 19, 20, 21 used of the cylinder 9, 10, 11 may be a gear whose number of teeth is 88 (=22×4) such as to print in the top-bottom length of 22 inches each time the cylinder 9, 10, 11 makes one rotation.

By the way, it has recently become frequent that the rotary press of this type is required of printing in a millimeter standard. Under such circumstances, if a conventional rotary press which corresponds to an inch unit is used to print in a millimeter standard, a wasteful, non-printed portion has appeared on printed paper and it has entailed troublesome operations to remove the non-printed portion.

For example, if a print having a top-bottom length of 555 mm is to be printed, a rotary cylinder for printing in a top-bottom length of 22 inches must have a peripheral length in millimeter size of 22×25.4=558.8 mm and must produce a non-printed portion of 3.6 mm in the top-bottom direction.

In order to get rid of such a non-printed portion, one might use a cylinder whose peripheral length if made in inch as its size length is close to 555 mm. It has not been possible, however, to make the pitch circle diameter of the driven gear provided for this cylinder coincident with the outer diameter of the above-mentioned cylinder.

As a result, in order to print a print of A4 size having a top-bottom length of 297 mm, one may use a gear having six teeth per inch pitch-circumferentially, namely having a CP of ⅙ and having 70 teeth, thus a gear having a pitch circumferential length of (⅙×70=11+⅔ inches) or 296.33 mm and a cylinder of a peripheral length identical to the latter. Then, the printing size obtained is an approximate size; there remain the problem that an accurate A4 printing size is not obtained.

Accordingly, of conventional rotary presses of this type, one have also been known (see, e. g., JP S58-138649 A) using a printing cylinder and a driven gear mounted coaxially thereof which are both with a millimeter standard and wherein the driven gear has a number of teeth made proper so that it can tune with a driving gear on the principal machine side.

In the preceding prior art, if the cylinders in a cylinder exchange unit are of a millimeter standard, the drive source for driving the exchange cylinder unit is of an inch standard so that the circular pitch of the gears on the driving and driven sides must be ¼, ⅙, ⅛, 1/10 inch or the like. As a result, only prints of printing lengths which are integral multiples of such a circular pitch can be printed; hence poor in flexibility. Also, in the case of printing on approximate values to millimeter standard sizes, there are limits in number of applicable gear trains so that no print can aptly be printed but on particular sizes. Also, depending on sizes, the circular pitch of a gear used may become small to an extent that the gear must have strength less than as needed. Furthermore, the limitation in numbers of applicable gear trains gives rise, e. g., to the problem that no print can be made but on sizes of a selected dimensional series.

With these problems taken into account, it is an object of the present invention to provide an exchangeable cylinder type rotary press which if designed on printing in an inch standard can, unrestricted thereby, be used on printing in a millimeter standard, which if designed on printing in any particular unit standard is capable of printing upon exchanging cylinders to those of any top-bottom length as desired, which allows the size of such cylinders to be freely set and which further permits, in addition to an exchange cylinder unit having any such top-bottom length as desired, an exchange cylinder unit, e. g., with an conventional inch unit standard to be used.

SUMMARY OF THE INVENTION

In order to achieve the object mentioned above there is provided in accordance with the present invention in a first aspect thereof an exchangeable cylinder type rotary press including a printing unit having an exchange cylinder unit removably mounted thereon, the exchange cylinder unit having a plurality of exchangeable rotary cylinders of an identical peripheral length, and a rotary printing paper feed means by which rotary printing paper to be printed in the printing unit is driven to travel, wherein: the peripheral length of each of the rotary cylinders in the exchange cylinder unit is a length to be set according to a top-bottom length of a print to be made; a profile-shifted gear is used as at least one of driven gears which are provided for the rotary cylinders, respectively, and have an identical number of teeth so that the driven gears can be engaged with one another while positioning the rotary cylinders in rotational contact with one another; the printing unit is provided in the exchange cylinder unit with a driving gear adapted to be disengageably in engagement with one of the driven gears for driving the exchangeable cylinders, the driving gear being provided independently of the rotary printing paper feed means; and a motor whose rotation is controllable is coupled to the driving gear.

The present invention also provides in a second aspect thereof an exchangeable cylinder type rotary press as described above, wherein in addition to the driving gear whose rotation is controllable by the rotation controllable motor, there is provided a further driving gear which is coupled to a power transmission system of the rotary printing paper feed means, said further driving gear is adapted to be in mesh with a driven gear in the exchange cylinder unit having a rotary cylinder of a peripheral length corresponding to a rate of travel of rotary printing paper.

The present invention also provides in a third aspect thereof, an exchangeable cylinder type rotary press including a printing unit having an exchange cylinder unit removably mounted thereon, the exchange cylinder unit having a plurality of exchangeable rotary cylinders of an identical peripheral length, and a rotary printing paper feed means by which rotary printing paper to be printed in the printing unit is driven to travel, wherein: the peripheral length of each of the rotary cylinders in the exchange cylinder unit is set at a length according to a top-bottom length of a print to be made; a profile-shifted gear is used as at least one of driven gears which are provided for the rotary cylinders, respectively, and have an identical number of teeth so that the driven gears can be engaged with one another while positioning the rotary cylinders in rotational contact with one another; one of the rotary cylinders in the exchange cylinder unit is provided with a further driven gear parallel to the driven gear for the one rotary cylinder; the printing unit is provided in exchange cylinder unit with a driving gear adapted to be disengageably in engagement with the further driven gear for the one rotary cylinder for driving the exchangeable cylinders, the driving gear being provided independently of the rotary printing paper feed means; and a motor whose rotation is controllable is coupled to the driving gear.

The present invention further provides in a fourth aspect thereof an exchangeable cylinder type rotary press as described above, wherein it includes a rotary paper rate of travel detecting means for detecting a rate of travel of rotary printing paper driven to travel by the rotary printing paper feed means, and a rotation control means for controlling the speed of rotation of the motor on the basis of a signal from the rotary paper rate of travel detecting means and the peripheral length of a rotary cylinder in the exchange cylinder unit so that the peripheral speed of the rotary cylinder in the exchange cylinder unit is made identical to the rate of feed of rotary printing paper.

According to the first aspect of the present invention, the advantage is offered that even with an exchangeable cylinder type rotary press driven by a single prime mover and using a gear train of inch standard in the power transmission system from the prime mover to driven units, it is possible to set as desired the respective peripheral lengths of a printing and an impression cylinder or a printing, a blanket and an impression cylinder in an exchange cylinder unit. Therefore, unrestricted to inch standard of the exchangeable cylinder type rotary press and no matter what size of unit standards including millimeter and inch standard is to be printed in, it is possible to make a print precise in top-bottom length by replacement of exchange cylinder units.

Also, while there may be physical limitations of the maximum and minimum sizes, unrestricted to the form or number of teeth of the driving gear in the unit used on the machine frame side and in any unit standard it is possible to obtain a print precise over an entire range from maximum and minimum limits.

Also, the second aspect of the present invention has the advantage that by providing the printing unit with a further driving gear coupled to the power transmission system from the prime mover, besides the driving gear drive by the motor, it is possible to mount an exchange cylinder unit of conventional inch standard with the further driving gear and thus to selectively use an exchange cylinder unit of conventional inch standard and an exchange cylinder unit for making a print of any top-bottom length as desired.

Further, the third aspect of the present invention offers the advantage that by providing a drive gear to be meshed with the driving gear, separately of a driven gear for each rotary cylinder in an exchange cylinder unit, the driven gear in mesh with the driving gear and the driven gears in mesh with one another for rotary cylinders can be made separate; it become unnecessary to make profile-shifted gear as the driven gear to be meshed with the driving gear. Then, since power from the driving gear is transmitted smoothly, the quality of printing is improved. Moreover, this aspect of the invention permits the respective driven gears for the rotary cylinders to be identical profile shifted gears. Then, it is possible to machine a number of such driven gears placed one over another at a time, thus reducing the machining steps while improving the machining accuracy.

DESCRIPTION OF THE PREFERRED EMBODIMENTS

Figure 1:
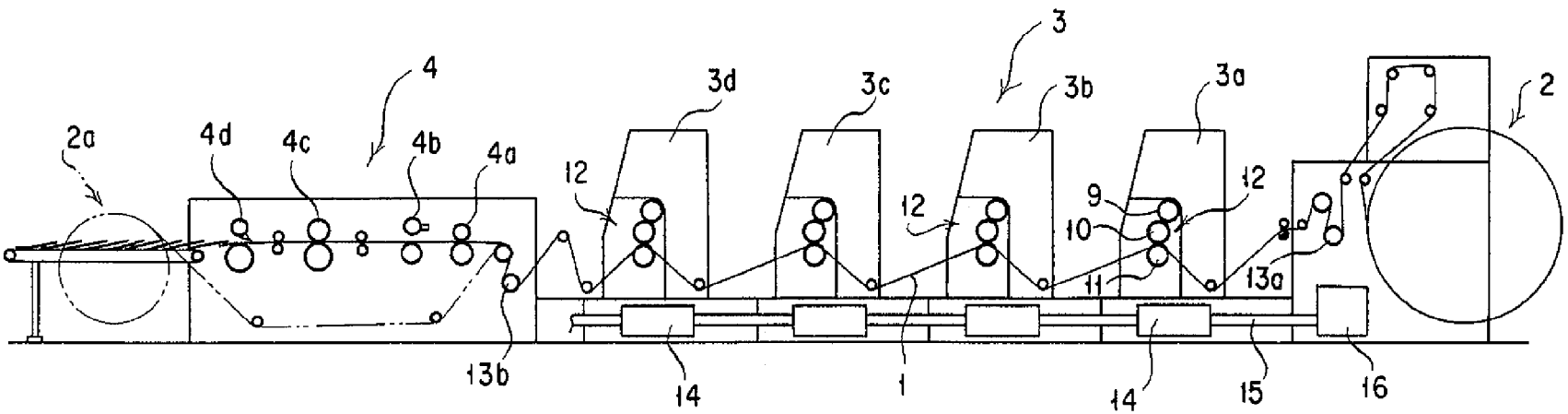
FIG. 1 PRIOR ART
FIG. 1 is a front view illustrating an example of the exchangeable cylinder type rotary press as viewed from the side of the primer mover.
Figure 2:
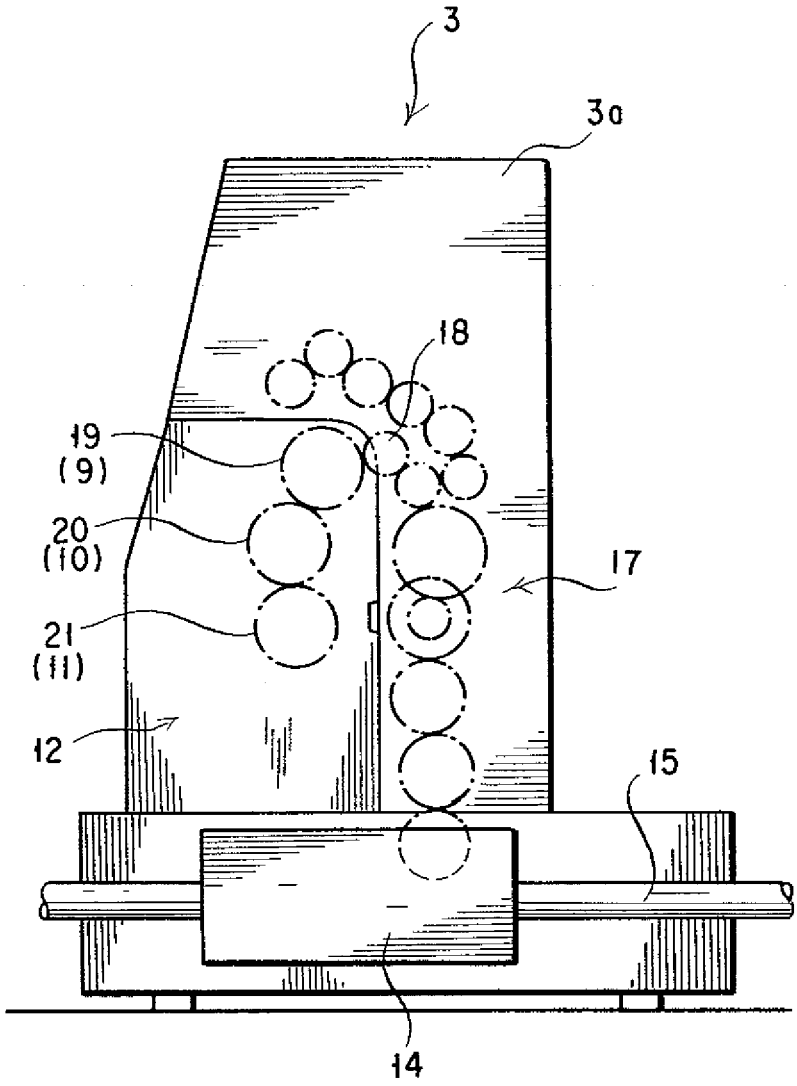
FIG. 2 PRIOR ART
FIG. 2 is a front view illustrating the power transmission system of a printing unit in the conventional exchangeable cylinder type rotary press.

An explanation is given hereinafter of preferred forms of implementation for carrying out the present invention with reference to FIG. 3 ff in which the same reference characters as those in FIGS. 1 and 2 are used to designate the same conventional components whose repeated description is omitted.

Figure 3:
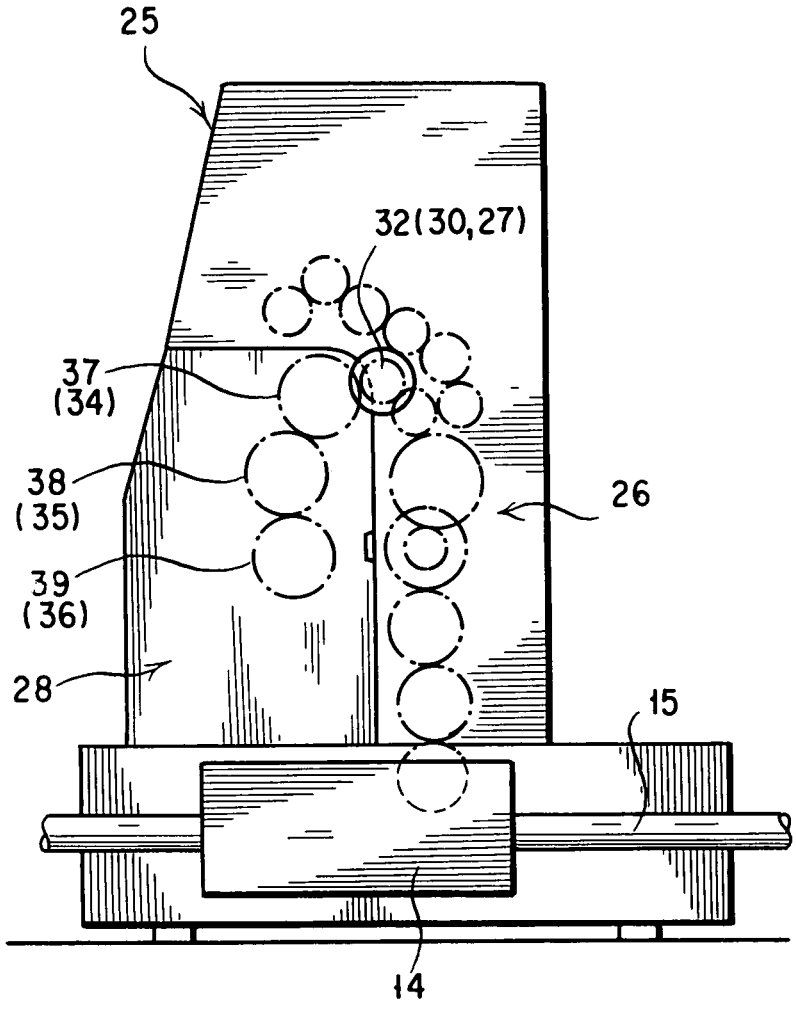
FIG. 3 is a front view illustrating the power transmission system of a printing unit in one form of implementation of an exchangeable cylinder type rotary press according to the present invention.
Figure 4:
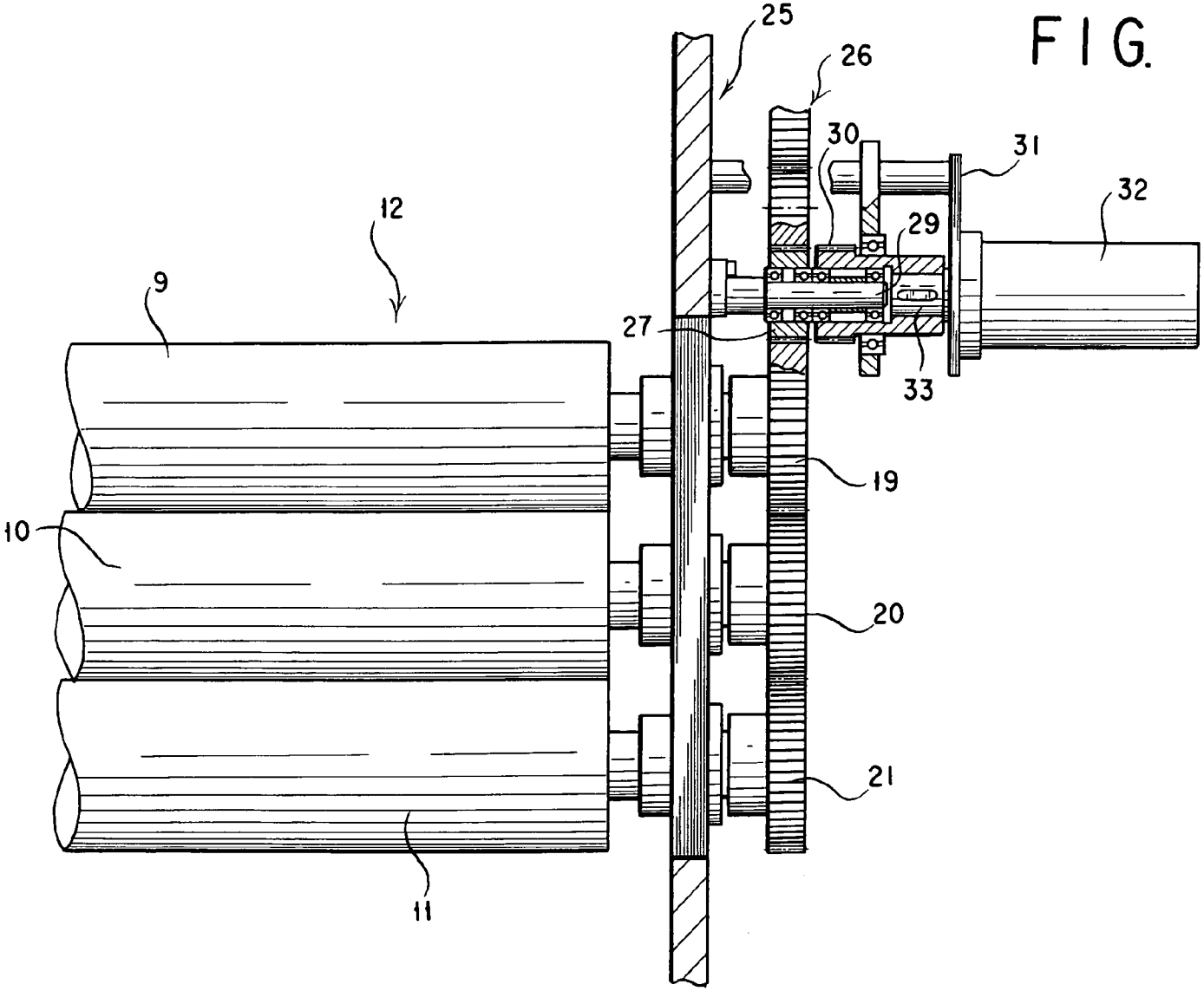
FIG. 4 is an explanatory view illustrating a gear construction in the state that a conventional exchange cylinder unit is mounted in the form of implementation of the invention.
Figure 5:
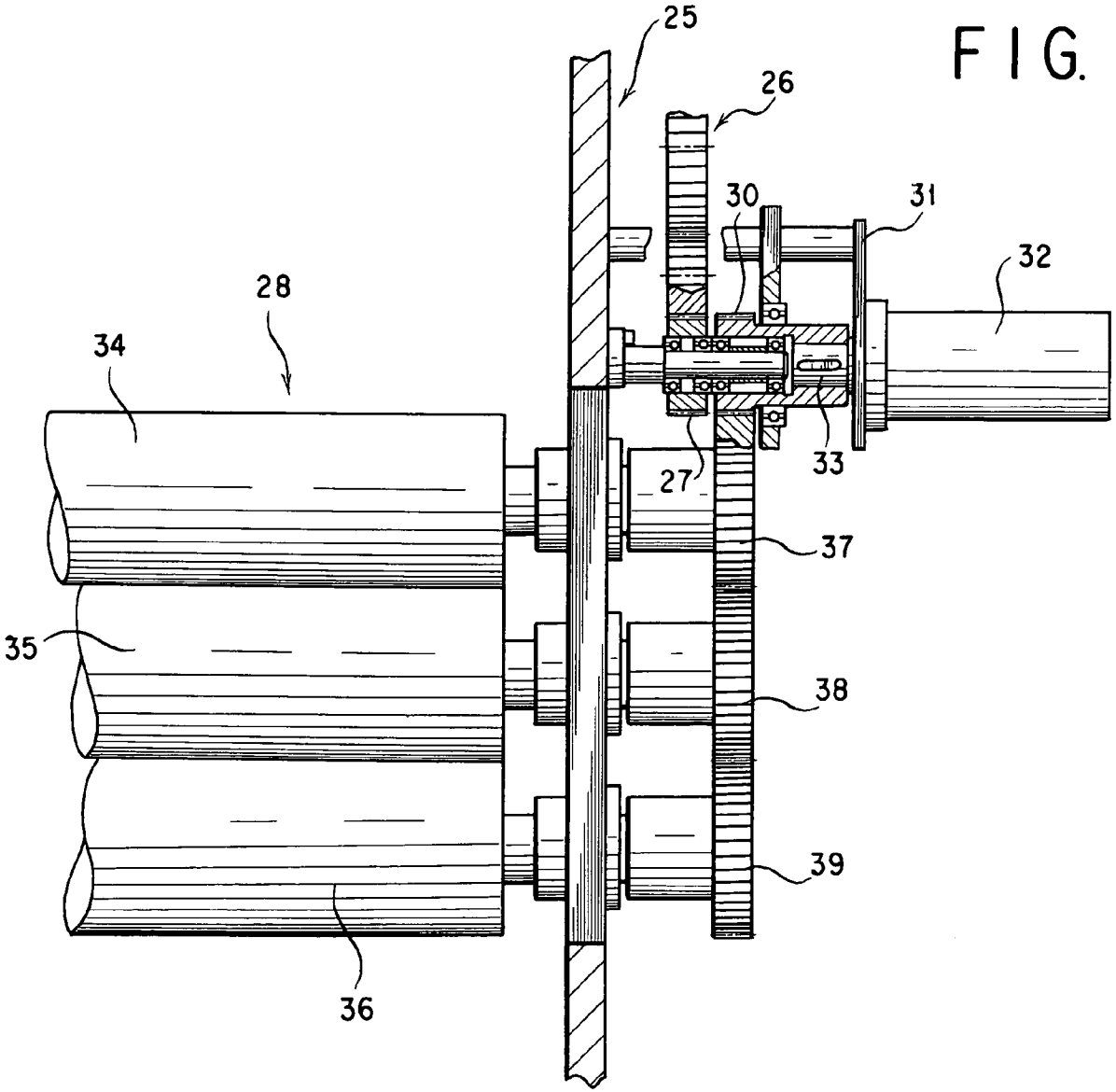
FIG. 5 is an explanatory view illustrating a gear construction in the state that an exchange cylinder unit of millimeter standard is mounted in the form of implementation of the invention.

FIG. 3 shows a power transmission system of a printing unit 25 in the printing section 3 shown in FIG. 1, in which a gear train 26 from the power transmission drive 14 is identical to that in the printing unit 3*a* in the prior art. FIGS. 4 and 5 show a driving gear 27 fro cylinder driving in the gear train 26, and are explanatory views in part fragmentary, illustrating that the conventional exchange cylinder unit 12 of inch standard and an exchange cylinder unit 28 of millimeter standard are mounted, respectively. Only one printing unit 25 or a plurality of such printing units is arranged as shown in FIG. 1 in the direction of travel of rotary printing paper 1.

The driving gear 27 for cylinder driving in the gear train 26 is the same as the driving gear 18 in the gear train 17 in the conventional printing unit 3*a*, 3*b*, 3*c* shown in FIG. 2. To wit, the driving gear 27 is of inch standard, having, e. g., the CP of ¼ and the number of teeth of 44 and being identical in axial position to the driving gear 18, too. Thus, as shown in FIG. 4 the printing unit 25 can have the conventional exchange cylinder unit 12 of inch standard mounted thereon and, in its mounting state, the driven gear 19 for its printing cylinder 9 is in mesh with the driving gear 27 so as to allow printing on the conventional inch standard.

The rotary press used in this form of implementation is designed, for example, so that one rotation of the driving shaft 15 causes one rotation of the driving gear 27 in each printing unit 25. Thus, the speed of travel of rotary printing paper 1 in this rotary press is assumed to be such that one rotation of the driving shaft 15 causes it to travel by 279.40 mm as a pitch circumferential length of the driving gear 27 which has the CP of ¼ (inch) and the number of teeth of 44.

The driving gear 27 as shown in FIGS. 4 and 5 is supported rotatably on a supporting shaft 29 in the principal machine side and coupled to the gear train 26. And, axially outside of this driving gear 27 and parallel thereto, a second driving gear 30 is supported rotatably on the supporting shaft 29, thus supported independently of the gear train 26 on the principal machine side. The second driving gear 30 is coupled to an output shaft 33 of a motor 32 supported via a bracket 31 on the principal machine side. This motor 32 is a sectional gear whose rotation is controlled by a controller. The second driving motor 30 may be of either inch or millimeter standard but, to be easy to understand in this form of implementation, is taken as of inch standard and having, e. g., the CP of ¼ and the number of teeth of 44.

An exchange cylinder unit 28 of millimeter standard as shown in FIG. 5 has a printing cylinder 34, a blanket cylinder 35 and an impression cylinder 36 thereof which each have an identical peripheral length of millimeter standard. The cylinders 34, 35 and 56 have their respective driven gears 37, 38 and 39 fastened thereto at respective axial ends thereof so that these driven gears are in mesh with each other and such that they have an identical circumferential length identical to the peripheral length of the cylinders 34, 35 to 36. A train of these driven gears is axially positioned flush with the second driving gear 30. When the exchange cylinder unit 28 is mounted on the printing unit 25, the driven gear 37 for the printing cylinder 34 is placed in mesh with the second driving gear 30.

The peripheral length of each of the cylinders 34 to 36 in the exchange cylinder unit 28 of millimeter standard may if necessary be set to have any value as desired. Then, the pitch circumferential length of the driven gear 37, 38, 38 for each cylinder is made identical to the latter's peripheral length, too.

In this case, while the peripheral length of each cylinder 34, 35, 36 can be set as desired, the pitch circumferential length of the driven gear 37, 38, 39 which is affected by the number of teeth cannot be set as desired. Thus, no matter how small a used tooth form may be, its pitch circumferential length cannot be made coincident with the cylinder's peripheral length. Accordingly, each driven gear 37, 38, 39 not coincident may have its pitch circular radius shifted to make its pitch circumferential length identical to the cylinder's peripheral length.

In this form of implementation, mention is made, e. g., of the case that for printing of an A4 size, namely with a top-bottom length of 297 mm by the exchange cylinder unit 28 of millimeter standard, each cylinder 34, 35. 36 in the exchange cylinder unit 28 has a peripheral length of 297 mm.

In this case, the driven gear 37, 38, 39 to be used for each cylinder 34, 35, 36 must be of a pitch circumferential length of 297 mm. Now, let it be that with the second driving gear 30 with which the driven gear 37 is in mesh being of inch standard of CP equal to ¼, each driven gear 37, 38, 39 is of CP=¼ inch standard.

If in this inch standard a gear having a pitch circumferential length of 297 mm is being designed, the number of teeth of a gear whose CP is equal to ¼ and whose circumferential length is the closest to this circumferential length is 47 and its pitch circumferential length is 298.45 mm. Thus, the pitch circumferential length of this gear must become longer by 1.45 mm than the peripheral length of the cylinder. Also, the pitch circle diameter then is 95.05 mm which becomes larger in diameter by 0.46 mm and in radius by 0.23 mm than the cylinder 34, 35, 36 (whose diameter is 94.59 mm). The result will be that with gears 37, 38 and 39 brought into mesh with one another, the circumferential surfaces of the cylinders become spaced apart from one another, that is, the inability to print.

Accordingly, each driven gear 37, 38, 39 when cut is shifted in its pitch circle radius by 0.23 mm to make a profile shifted gear having a pitch radius of 94.59 mm. This allows the gears 37, 38 and 39 to rotate in mesh with one another, thereby rotating the cylinders 34, 35 and 37 while in contact with one another, thus permitting a print of 297 mm in top-bottom length to be printed each time the cylinder 34, 35, 36 makes one rotation.

And, the exchange cylinder unit 28 of such a construction when mounted on the printing unit 25 is as shown in FIG. 5 wherein the driven gear 37 for its printing cylinder 34 is in mesh with the second driving gear 30 on the principal machine side so that the exchange cylinder unit 28 may be driven by the second driving gear 30.

Then, the pitch circle radius of the driven gear 37 for the printing cylinder 34 is shifted by 0.23 mm so that its pitch circumferential length is now 297 mm, that is shorter by 1.45 mm than the pitch circumferential length of 298.45 mm of a standard gear whose number of teeth is 47. The peripheral lengths of the cylinders 34, 35, 36 are alike in that respect.

On the other hand, the feed rate of rotary printing paper 1 in the rotary press with a standard driven gear whose number of teeth is 47 (whose pitch circumferential length is 11+¾ inches) is that at which rotary printing paper is fed over the distance of 298.45 mm as the pitch circumferential length of the driven gear in the time period in which the driven gear makes one rotation. However, since the driven gear 37 for the printing cylinder 34 in the exchange cylinder unit 28 of the present invention has the pitch circumferential length of 297 mm which is 1.45 mm shorter than the standard one and the cylinder 34, 35, 36 has the peripheral length of the same 297 mm, rotating the cylinder 34, 35, 36 at the same speed of rotation as that of the cylinder 9, 10, 11 of inch standard makes its peripheral speed slower than the feed rate of rotary printing paper 1 so that normal printing becomes no longer possible.

Accordingly, in the rotary press of the present invention, the speed of rotation of the second driving gear 30 is increased by an amount by which the pitch circle diameter of the driven gear 37, 38, 39 is made smaller than that of the standard one, this being effected by controlling, with a control system, the motor 32 for driving the driven gear, so that the peripheral speed of the cylinder 34, 35, 36 in the exchange cylinder unit 28 is made identical to the feed rate of rotary printing paper 1 driven to travel by the driving shaft 15.

In the rotary press so constructed, the peripheral speed of each of the printing cylinder 34, the blanket cylinder 35 and the impression cylinder 36 becomes identical to the feed rate or speed of travel of rotary printing paper 1 driven to travel by the prime mover 16 so that a print of millimeter standard with 297 mm as top-bottom length can normally be printed by each exchange cylinder unit 25.

And, according to the construction mentioned above, even in an exchangeable cylinder type rotary press with an exchange cylinder unit being driven by a train of gears of inch standard to print a print normally of inch standard, it is possible to print a print of millimeter standard with the exchange cylinder unit by making the peripheral length of each rotary cylinder in the exchange cylinder unit identical to a top-bottom length of the print, forming a profile shifted, driven gear for the rotary cylinder with its pitch circumferential length adjusted, providing the driven gear for the rotary cylinder independently of the gear train of inch standard and driving the driven gear for the rotary cylinder with a motor so that the rotary cylinder has a peripheral speed that is identical to a speed of travel of rotary printing paper being driven to travel by the gear train of inch standard. Further, in printing a print not only of millimeter standard but also of inch standard, it is possible to print in any top-bottom length as desired, unrestrained from a gear ratio of the gear train.

As will be described later, in the rotary press of the present invention a paper feed rate detector may be provided for detecting a feed rate of rotary printing paper 1. This detector may be designed to detect a unit amount of travel of rotary printing paper 1, e. g., amount of its travel for one rotation of the driven gear 27 (e. g., 279.40 mm that corresponds to a pitch circumferential length of a gear of which CP is ¼ and the number of teeth is 44).

And, in the control system for controlling the motor 32, a signal from the paper feed rate detector and a peripheral length of a printing cylinder 34 (or a pitch circumferential length of a driven gear 37 then used in the exchange cylinder unit 28 or a respective diameter) are input, and these input values and a gear ratio between the second driving gear 30 and the driven gear 37 for the printing cylinder 34 are processed to control the motor 30 so that the peripheral speed of the printing cylinder 34 is identical to the feed rate of rotary printing paper made.

While in this form of implementation to ease its understanding, mention is made of an example in which the second driving gear 30 is identical to the first driving gear 27, the second driving gear 30 which as described above is rotated at a speed of rotation set at the motor 32 as desired may be a gear of any standard and any number of teeth as desired. And, the driven gears 37, 38 and 39 in the exchange cylinder unit 28 may be gears in accordance with this second driving gear 30. Also, while in the form of implementation shown in FIGS. 4 and 5 an example is shown in which the second driving gear 30 is rotatably supported by the supporting shaft 29 supporting the driving gear 27, this second driving gear 30 may not be supported by the supporting shaft 29 but may be fastened directly to the output shaft 33 of the motor 32. And, the second driving gear 30 needs not necessarily to be positioned coaxially with the driving shaft 27 but is positioned so as to be in mesh with the driven gear 37 for the printing cylinder 34 in accordance therewith.

Also, while in this form of implementation an example is shown in which the peripheral length of each cylinder in the exchange cylinder unit 28 is 297 mm of A4 size, each cylinder may be one having a peripheral length that is an integral multiple of this length so that a plurality of prints may be made for one ration of the cylinder.

Figure 6:
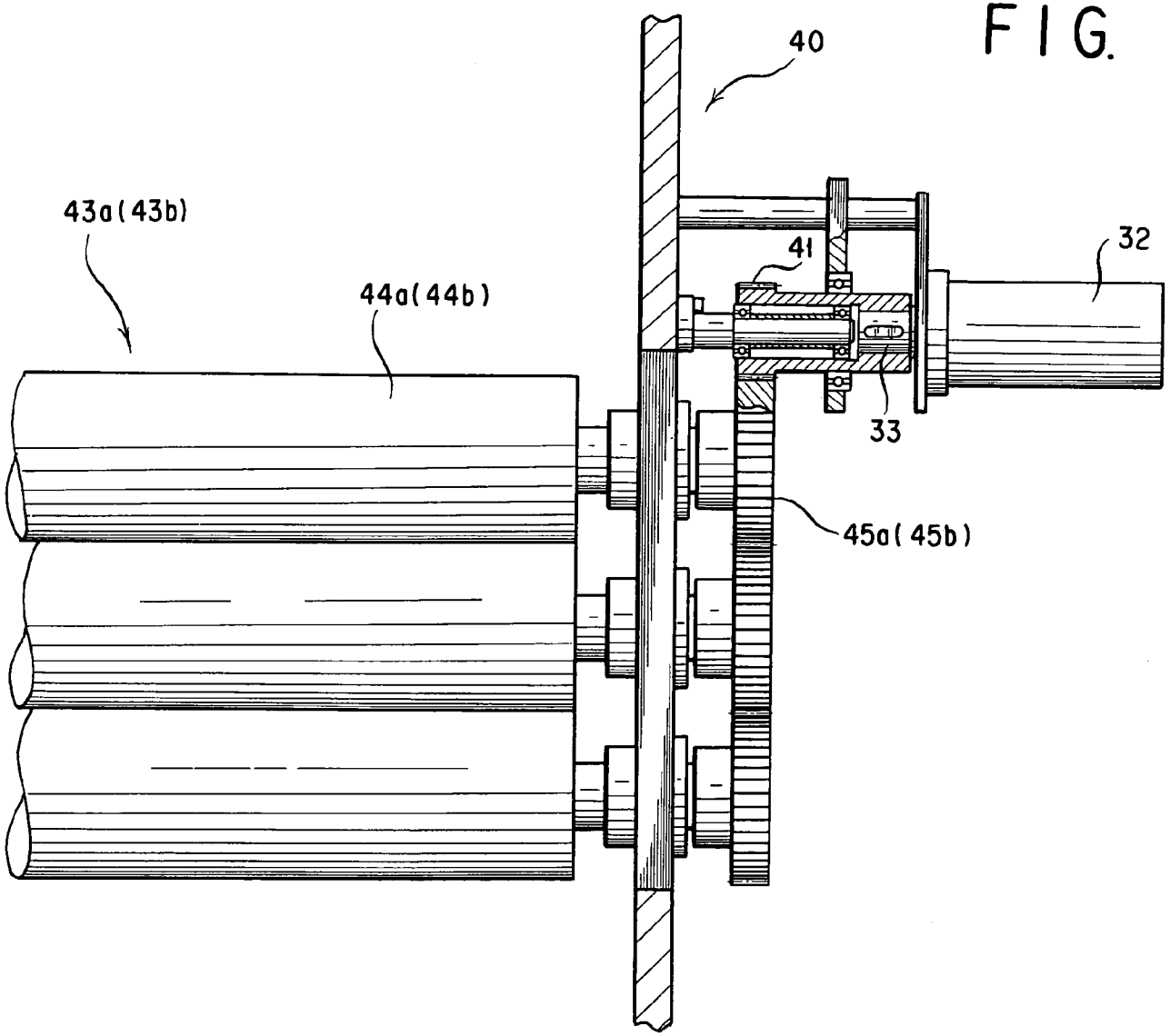
FIG. 6 is an explanatory view illustrating an another embodiment of gear construction according to the present invention.

FIG. 6 shows another form of implementation of the invention in which the driving gear 27 on the side of the gear train 26 connected to the driving shaft 15 is omitted from a printing unit 25 as shown in FIGS. 3 and 4 to constitute a printing unit 40 and the gear train 26 is designed here to solely drive an inking unit as mounted above the printing unit 25. And, in place of the driving gear 27 a third driving gear 41 of inch standard or alternatively of millimeter standard is selectively provided so that it does not interfere with the gear train 26 and the third driving gear 41 in this construction is coupled to the drive shaft 33 of the motor 32 as shown in FIGS. 3 and 4, whose rotation is made freely controllable.

And, on this printing unit 40, an exchange cylinder unit 43*a* of inch standard or an exchange cylinder unit 43*b* of millimeter standard which may be chosen according to the unit standard of the third driving gear 41 is mounted so that driven gears 45*a* or 45*b* of their respective printing cylinders 44*a* or 44*b* are in mesh with the third driving gear 41. Then, the speed of rotation of the exchange cylinder unit 43*a* or 43*b* is controlled by controlling the rotation of the motor 32.

Each of the driven gears for cylinders in each exchange cylinder unit in this form of implementation, too, is made of a profile shifted gear whose pitch circle radius is shifted and which has a number of teeth selected according to a size of peripheral length of the corresponding cylinders, so that the driven gears may smoothly be engaged with one another in the state that these cylinders rotate in contact with one another.

Figure 7:
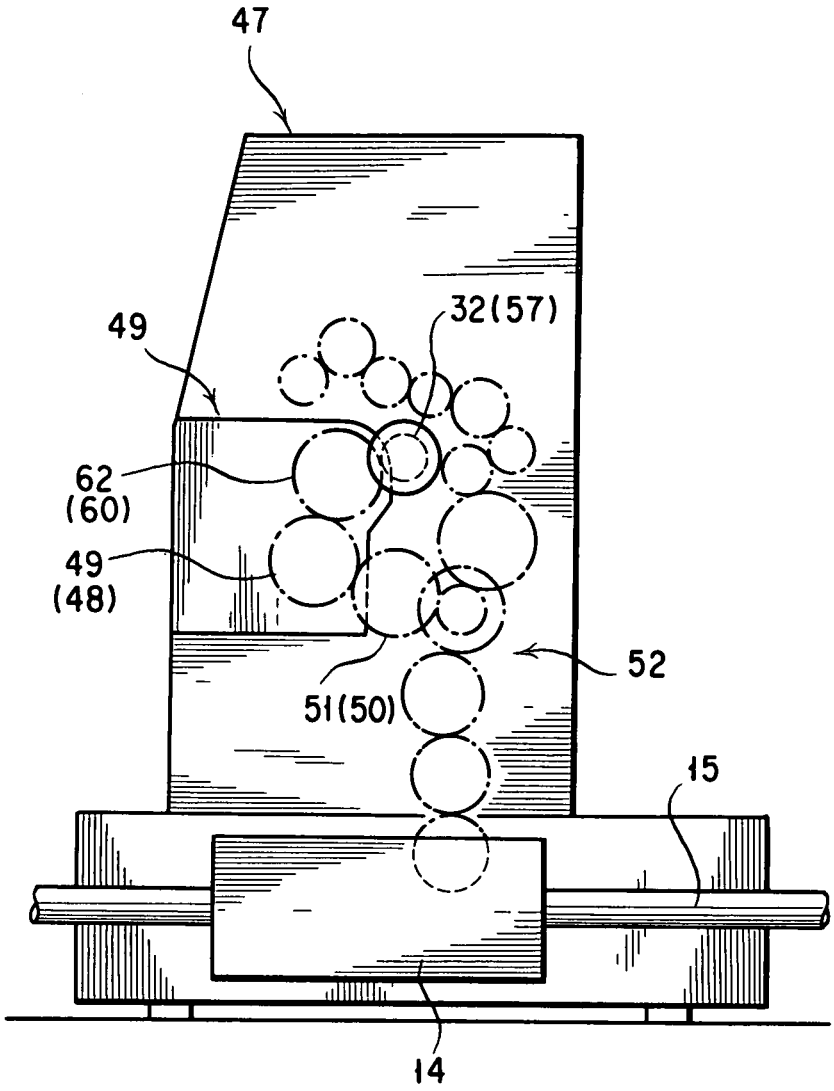
FIG. 7 is a front view illustrating the power transmission system of a printing unit in another form of implementation of a two-exchangeable cylinder type rotary press according to the present invention.
Figure 8:
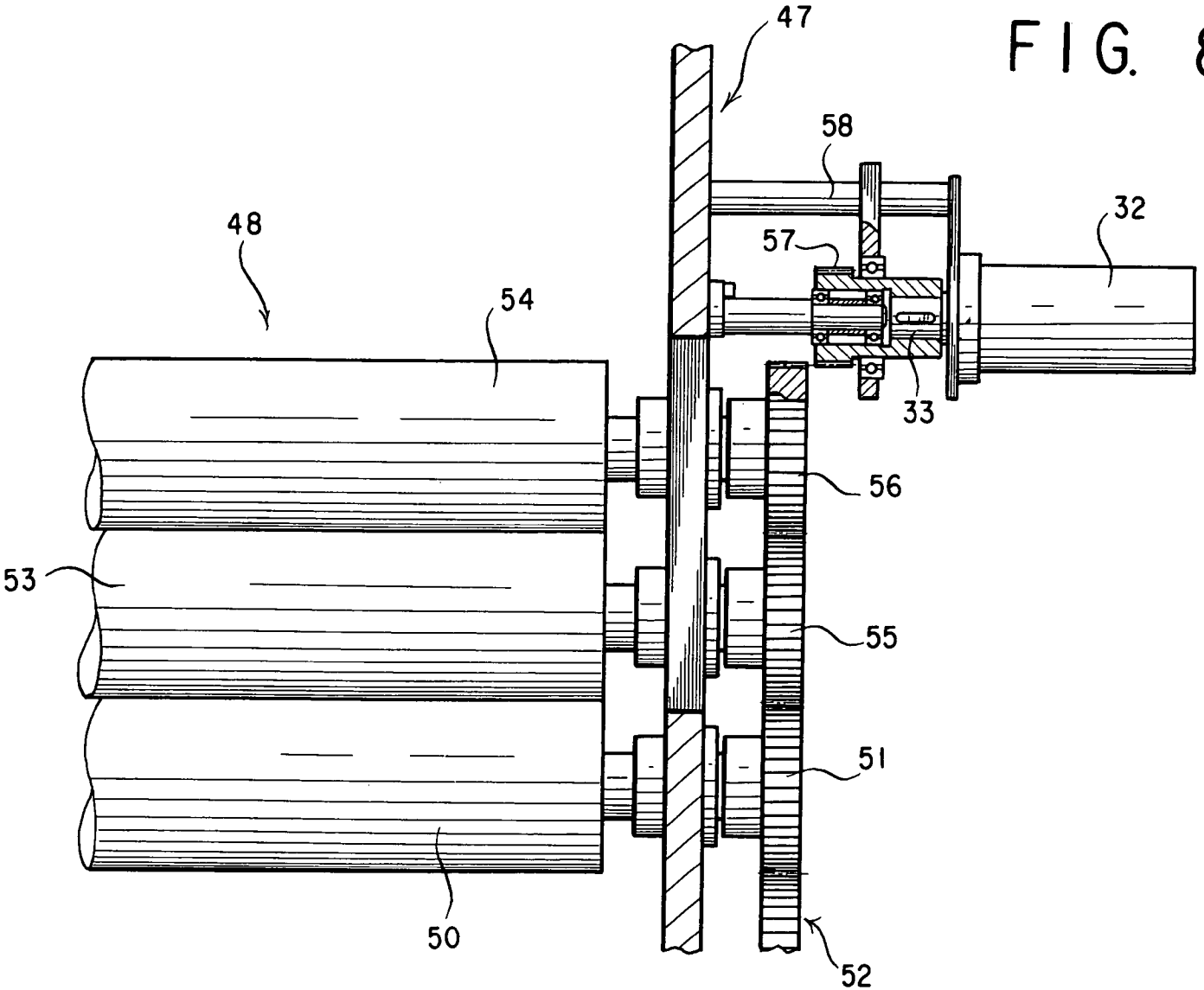
FIG. 8 is an explanatory view illustrating a gear construction in the state that a conventional exchange cylinder unit is mounted in the two-exchangeable cylinder type rotary press.
Figure 9:
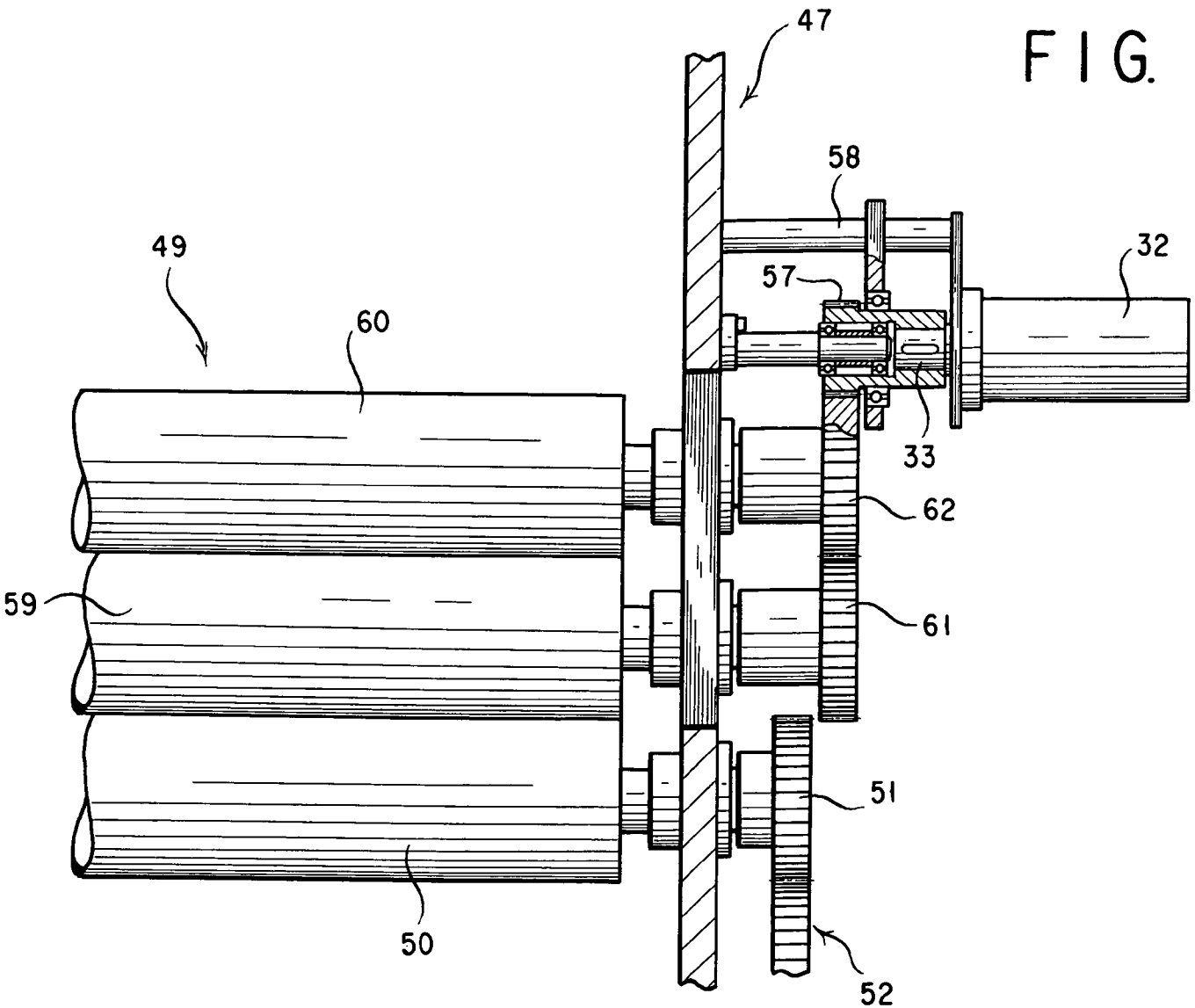
FIG. 9 is an explanatory view illustrating a gear construction in the state that an exchange cylinder unit of millimeter standard is mounted in the two-exchangeable cylinder type rotary press.

FIGS. 7, 8 and 9 shows a printing unit 47 of three cylinders using a two-cylinder exchangeable, exchange cylinder unit in which a printing and a blanket cylinder are exchanged. FIG. 7 is an explanatory view illustrating its power transmission system, and FIGS. 8 and 9 are explanatory views illustrating, respectively, a conventional two-cylinder exchangeable, exchange cylinder unit 48 in the prior art and a two-cylinder exchangeable, exchange cylinder unit 49 of millimeter standard according to the present invention, when mounted in the printing unit.

In the printing unit 47 using the two-cylinder exchangeable, exchange cylinder unit 49 of the present invention, an impression cylinder 50 is mounted on the principal machine side and its driven gear 51 is coupled to a gear train 52 on the principal machine side. And, in the conventional two-cylinder exchangeable, exchange cylinder unit 48 comprising blanket and printing cylinders 53 and 54 and their respective driven gears 55 and 56 is mounted in the state that as shown in FIG. 8, the blanket cylinder 53 is rotated in contact with the impression cylinder 50 and its driven gear 55 is in mesh with a driven gear 51 for the impression cylinder 50, hence the exchange cylinder unit 48 is so designed that it is driven by the driven gear 51 for the impression cylinder 50.

In the printing unit 47 in which it is made possible to mount the two-cylinder exchangeable, exchange cylinder unit 49 of the present invention, a fourth driving gear 57 is provided on a shaft provided on the principal machine side at a position adjacent in mating direction to but axially deviated from the driven gear 56 for the printing cylinder 54 in the conventional two-cylinder exchangeable, exchange cylinder unit 48, independently of the gear train 52 on the principal machine side. And, the four driving gear 57 is coupled to the output shaft 33 of the motor 32 supported by a bracket 58 on the principal machine side. The fourth driving gear 57 is deviated, e. g., outwards from the axial positions of the driven gears 55 and 56 in the conventional two-cylinder exchangeable, exchange cylinder unit 48 so that it may not interfere with the driven gear 56 for the printing cylinder 54. Now assume that the fourth driving gear 57 is made of a gear whose CP is ¼ and number of teeth is 44 as in the printing unit 25 in which it is made possible to mount, e. g., the three-cylinder exchangeable, exchange cylinder unit 28 mentioned previously.

And, in the two-cylinder exchangeable, exchange cylinder unit 49 of millimeter standard according to the present invention, blanket and printing cylinders 59 and 60 are constructed to be conventional as shown in FIG. 8 and their driven gears 61 and 62 engaged with each other are axially positioned flush with the fourth gear 57 so that the driven gear 62 for the printing cylinder 60 may removably be meshed with the fourth driving gear 57. Thus, the driving gear 61 for the blanket cylinder 59 is designed to be not in mesh with the driven gear 51 for the impression cylinder 50 on the principal machine side.

Then, for example, if a size of 297 mm in top-bottom length (A4 size) is to be printed with the two-cylinder exchangeable, exchange cylinder unit 49 of millimeter standard, as in the case of the three-cylinder exchangeable, exchange cylinder unit 28 mentioned above a printing and a blanket cylinder 60 and 59 whose peripheral length is 297 mm is prepared and for each of the driven gears 62 and 61 is made of a profile shifted gear whose pitch circle radius is shifted so that they may smoothly be engaged with one another in the state that their cylinders rotate in contact with one another. Thereupon, the motor 32 is controlled so that the printing and blanket cylinders 60 and 59 may rotate at a speed of rotation coincident to a rate of travel of rotary printing paper over the entire rotary press machine. Then, the blanket cylinder 59 is rotated in contact with the impression cylinder 50 rotationally driven by the gear train 52 on the principal machine side which is different in power transmission system from the blanket cylinder 59, there is no slip in this rotational contact area since the blanket cylinder 59 is rotated at the same peripheral speed as that of the impression cylinder 50.

While in the forms of implementation mentioned above, the driven gears 37 to 39 shown in FIGS. 3, 4 and 5 are gears whose amounts of shift (addendum modification) are identical to each other so that their pitch circumferential length is identical to the circumferential length of their corresponding cylinders, only the driven gear 38 for the blanket 35 centered may have its pitch circle radius shifted.

To wit, for the driven gears 37 and 39 for the printing and impression cylinders 34 and 36 their pitch circle radii may be shifted to have amounts of shift of zero and for the driven gear 38 for the centered blanket cylinder 35 its pitch circle radius may be shifted by an amount of shift that is twice as large as those of the corresponding gears in the abovementioned form of implementation.

By so doing, it is possible to make un-shifted gears engagement between the second driving gear 30 and the driven gear 37 for the printing cylinder 34 and also, in driving with the second driving gear 30, to solve problems in a profile shifted gear, e. g., to prevent shortage of strength at its dedendum due to its undercutting. Further, it then comes about that the pitch circle diameter of the driven gear 37 for the printing cylinder 34 is not coincident with the outer diameter of the printing cylinder 24. Accordingly, the second driving gear 30 to be meshed with this driven gear 37 is in advance placed at a position at which it can be meshed with this driven gear 37.

Figure 10:
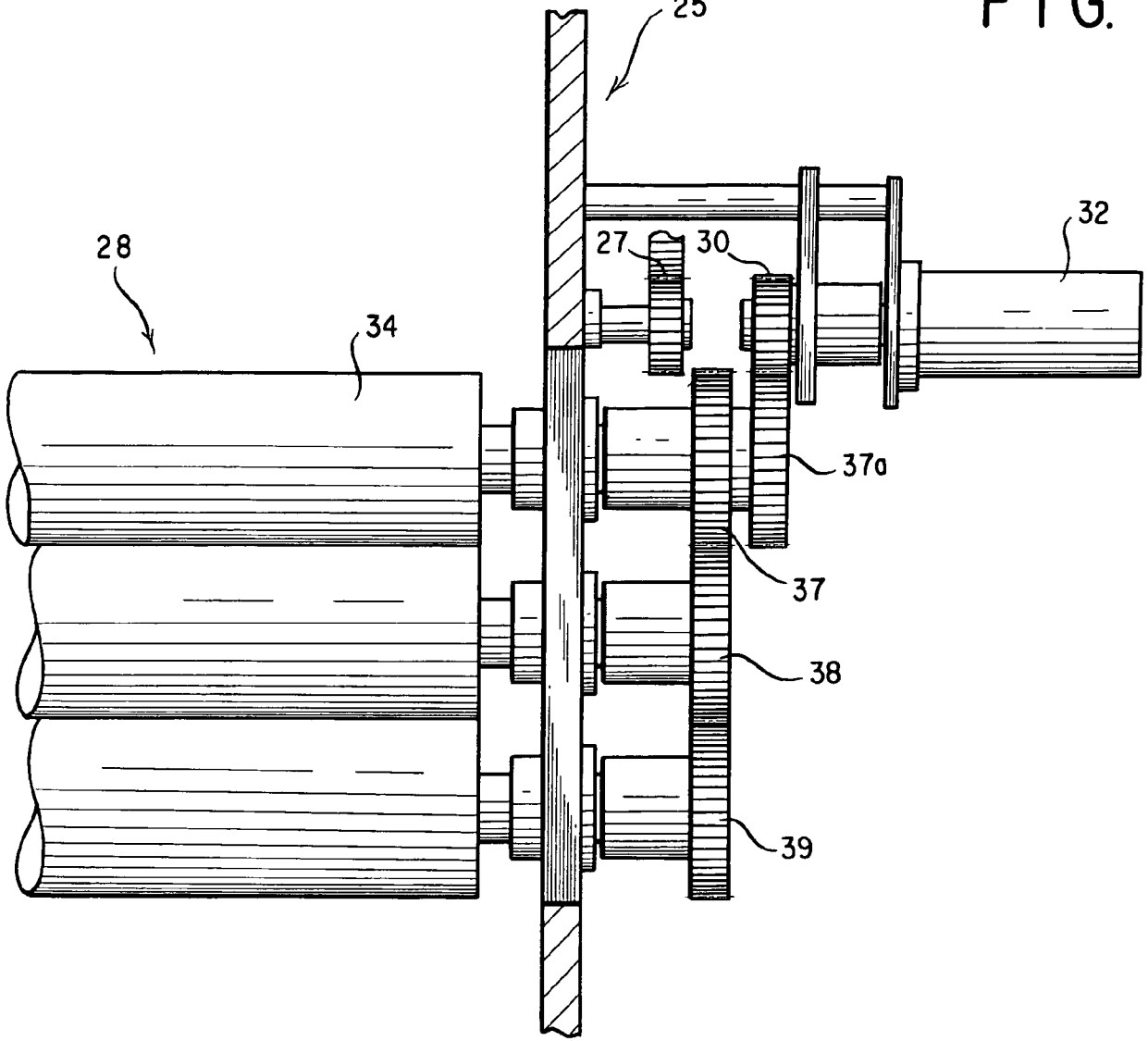
FIG. 10 is an explanatory view illustrating a gear construction where a driven gear train and a driving gear train for each cylinder in an exchange cylinder unit according to a further form of implementation of the present invention.

Also, in order to make zero shift gears engagement between the second driving gear 30 and a driven gear in this manner, as shown in FIG. 10 the printing cylinder 34 may be provided parallel with the driven gear 37 with a further drive gear 37*a* with zero shift having the same number of teeth as the driven gear 37, for engagement with the second driving gear 30.

And, according to this construction, it becomes possible to smoothly effect power transmission through drive systems for cylinders in an exchange cylinder unit 28 and contribute to further improving the quality of printing. Also, according to this construction, the driven gears 37 to 39 for the cylinders 34 to 36 can advantageously be profile shifted gears of an identical number of teeth and an identical amount of shift and can thus be identical profile shifted gears. And, they can also be machined at a time simply with a plurality of ones placed one over another. Gear precision then is improved over making separately a plurality of gears different in amount of shift, thereby improving the quality of printing.

While in the forms of implementation mentioned above, the exchange cylinder unit is shown being three cylinder type comprising printing, blanket and impression cylinders, namely for offset printing, suffice it to say that it may be two cylinder type of printing and impression cylinders for direct printing. In this case, at least one of the two driven gears uses a profile shifted gear, too, having a pitch circumferential length adjusted to a peripheral length of its corresponding cylinder.

It may also be noted that the driven gears annexed to the cylinders in an exchange cylinder unit typically use spur gears but may also use helical gears.

Figure 11:
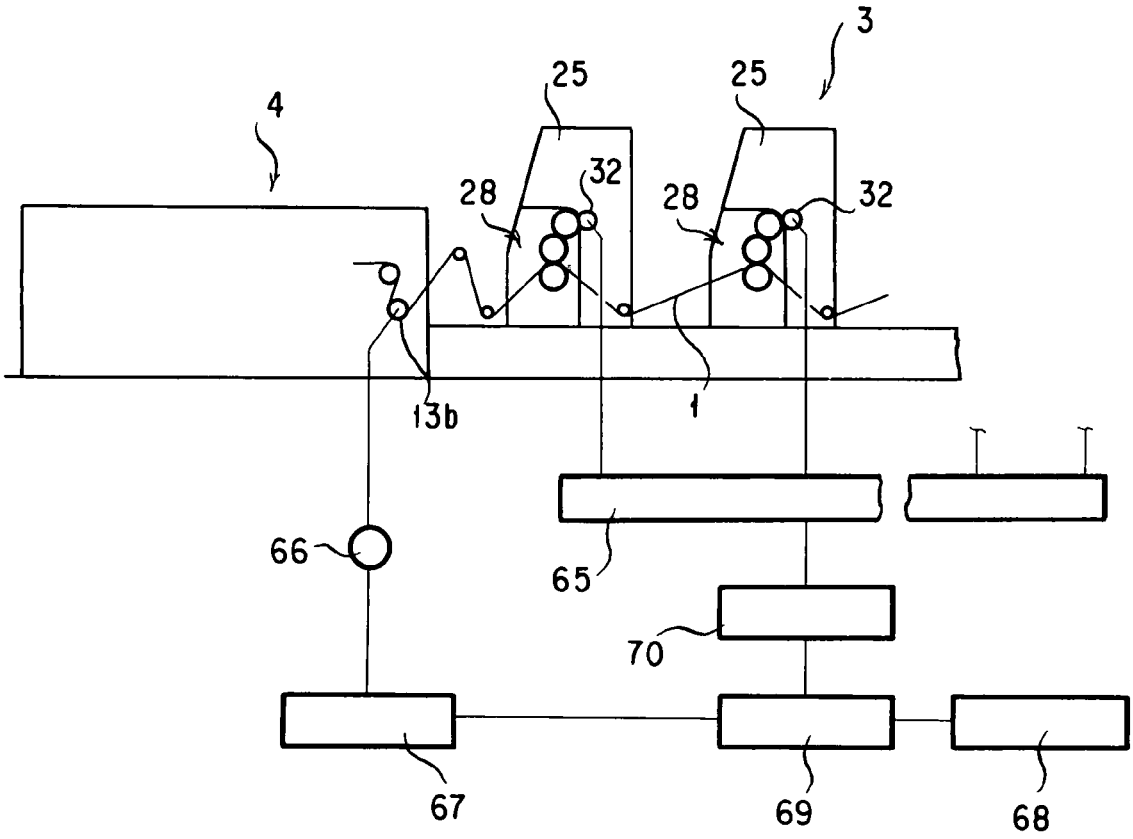
FIG. 11 is a block diagram illustrating a motor control system applicable to the forms of implementation of the present invention.

FIG. 11 shows an exemplary control system for controlling motors 32 used to rotate the second, third and fourth driving gears 30, 41 and 57 in each of printing units 25. The control system includes a motor driver 65 for controlling drive of the motor 32, a rotary encoder 66 for detecting the speed of rotation of the tension roller 13*b* in the machining section (or of the paper feed roller 13*a* in the rotary printing paper supply), and a rotary printing paper feed detecting section 67 for detecting the amount of feed of rotary printing paper 1 in response to a rotary printing paper feeder drive signal from the rotary encoder 66. Included also are a printing size input unit 68, a processing unit 69 and a servo controller 70 for feeding a signal from the processing unit 69 to the motor driver 65.

And, in this control system, a signal from the rotary printing paper feed detecting section 67 and a printing size signal of the exchange cylinder unit 28 then used, from the printing size input unit 68 are processed at the processing unit 69 whose output signal is input to the motor driver 65 via the servo controller 70. And, the motor 32 is driven by the motor driver 65 in response to an signal from the processing unit 69 so that the peripheral speed of the printing cylinder 34, 44*a*, 44*b*, 60 driven by the motor 32 is identical to the rate of travel of rotary printing paper 1 run by the prime mover 16.

What is claimed is:

1. An exchangeable cylinder type rotary press including:

a printing unit having an exchange cylinder unit removably mounted thereon, the exchange cylinder unit comprising a plurality of exchangeable rotary cylinders of an identical peripheral length, and the rotary cylinders having a fixed combination for printing; and a rotary printing paper feed means by which rotary printing paper to be printed in the printing unit is driven to travel, wherein:

the peripheral length of each of said rotary cylinders in the exchange cylinder unit, is a length to be set according to a top-bottom length of a print to be made;

the exchange cylinder unit is configured with one of an inch standard and a millimeter standard, the rotary press being configured to permit printing of a print with the other of the inch standard and millimeter standard, and said rotary cylinders of one of inch standard and millimeter standard are provided with driven gears of the other of inch standard and millimeter standard, respectively;

a profile-shifted gear is used as at least one of a plurality of said driven gears, and each of the plural driven gears having an identical number of teeth so that the driven gears can be engaged with one another while positioning said rotary cylinders in a rotational contact with one another;

said printing unit is provided with a driving gear adapted to be disengageably in engagement with one of said driven gears in said exchange cylinder unit for driving said rotary cylinders in the exchange cylinder unit, said driving gear being provided independently of said rotary printing paper feed means; and said driving gear and said plural driven gears constitute a single-row gear train for driving the rotary cylinders having peripheral lengths set as desired; and a motor whose rotation is controllable and is coupled to said driving gear, wherein said profile-shifted gear enables printing of a print of one of inch standard and millimeter standard with the exchange cylinder unit provided with driven gears of the other of inch standard and millimeter standard and changing the peripheral lengths of said rotary cylinders, unrestrained from a gear standard of the gear train.

2. An exchangeable cylinder type rotary press as set forth in claim 1, wherein in addition to said driving gear whose rotation is controllable by said rotation controllable motor, there is provided a further driving gear which is coupled to a power transmission system of the rotary printing paper feed means, said further driving gear is adapted to mesh with a said driven gear in the exchange cylinder unit having a said rotary cylinder of a peripheral length corresponding to a rate of travel of rotary printing paper.

3. An exchangeable cylinder type rotary press as set forth in claim 2, further comprising:

a rotary paper rate of travel detecting means for detecting a rate of travel of rotary printing paper driven to travel by said rotary printing paper feed means; and a rotation control means for controlling the speed of rotation of said motor on the basis of a signal from said rotary paper rate of travel detecting means and the peripheral length of a said rotary cylinder in the exchange cylinder unit, wherein the peripheral speed of said rotary cylinder in the exchange cylinder unit is made identical to the rate of feed of rotary printing paper.

4. The exchangeable cylinder type rotary press as set forth in claim 2, wherein said driving gear and said further driving gear are supported rotatably on a same shaft and independently rotatable of each other.

5. The exchangeable cylinder type rotary press as set forth in claim 2, wherein a said driven gear for a plate cylinder which is one of said rotary cylinders is adapted to be disengageably in engagement with each of said driving gears.

6. An exchangeable cylinder type rotary press as set forth in claim 1, further comprising:

a rotary paper rate of travel detecting means for detecting a rate of travel of rotary printing paper driven to travel by said rotary printing paper feed means; and a rotation control means for controlling the speed of rotation of said motor on the basis of a signal from said rotary paper rate of travel detecting means and the peripheral length of a said rotary cylinder in the exchange cylinder unit, wherein the peripheral speed of said rotary cylinder in the exchange cylinder unit is made identical to the rate of feed of rotary printing paper.

7. The exchangeable cylinder type rotary press as set forth in claim 1, wherein a said driven gear for a plate cylinder which is one of said rotary cylinders is adapted to be disengageably in engagement with said driving gear.

* * * * *